US008132323B2

(12) United States Patent
Rodrigues

(10) Patent No.: US 8,132,323 B2
(45) Date of Patent: Mar. 13, 2012

(54) COAXIAL CABLE INSTALLATION TOOL

(75) Inventor: Julio Rodrigues, Collierville, TN (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 12/683,051

(22) Filed: Jan. 6, 2010

(65) Prior Publication Data

US 2010/0170090 A1 Jul. 8, 2010

Related U.S. Application Data

(60) Provisional application No. 61/143,031, filed on Jan. 7, 2009.

(51) Int. Cl.
*H01R 43/04* (2006.01)

(52) U.S. Cl. ..... 29/861; 29/748; 29/753; 29/758; 29/857; 29/280; 81/347; 81/355; 81/419

(58) Field of Classification Search ..... 29/750–753, 29/758, 270, 278, 280, 857, 861; 81/347, 81/352–355, 418–419
See application file for complete search history.

(56) References Cited

U.S. PATENT DOCUMENTS 2,369,180 A 2/1945 Rosenthal
3,047,043 A 7/1962 Albrecht
3,156,139 A * 11/1964 Willis ..... 72/402
3,706,123 A 12/1972 Whitledge
3,849,858 A 11/1974 Whitledge et al.
3,851,514 A 12/1974 Chen et al.
3,967,356 A * 7/1976 Holt ..... 29/701
3,980,805 A 9/1976 Lipari
4,034,592 A 7/1977 Chen et al.
4,034,593 A 7/1977 Patel
4,285,228 A 8/1981 Gunning
4,307,504 A 12/1981 Davis et al.
4,334,353 A * 6/1982 Holt ..... 29/753
4,349,944 A 9/1982 Fickes
4,558,584 A 12/1985 Myers
4,729,531 A 3/1988 Smith et al.
4,781,055 A 11/1988 Phipps
4,784,669 A * 11/1988 Maack ..... 29/566.4
4,982,631 A * 1/1991 Lowther ..... 81/426
5,305,510 A 4/1994 Croft et al.
5,647,119 A * 7/1997 Bourbeau et al. ..... 29/751
5,934,137 A 8/1999 Tarpill
5,941,120 A 8/1999 Jee
5,943,460 A 8/1999 Mead et al.
6,272,738 B1 * 8/2001 Holliday et al. ..... 29/751
6,293,004 B1 * 9/2001 Holliday ..... 29/751
6,530,152 B1 3/2003 Christensen et al.
6,530,807 B2 * 3/2003 Rodrigues et al. ..... 439/578
6,708,396 B2 3/2004 Holliday
6,820,326 B1 11/2004 Tarpill et al.

(Continued)

*Primary Examiner* — Derris Banks
*Assistant Examiner* — Azm Parvez
(74) *Attorney, Agent, or Firm* — Foley & Lardner LLP

(57) ABSTRACT

A tool for installing an end of a cable into a connector generally includes a front jaw assembly adapted to retain the cable connector and a back jaw assembly movably coupled to the front jaw assembly. The cable connector includes a connector body and a compression sleeve and the back jaw assembly is adapted to insert an end of the cable into the cable connector upon movement of the back jaw assembly toward the front jaw assembly and subsequently press the compression sleeve into the connector body upon further movement of the back jaw assembly toward the front jaw assembly.

20 Claims, 6 Drawing Sheets

U.S. PATENT DOCUMENTS

| | | | | |
|---|---|---|---|---|
| 6,859,987 | B2 | 3/2005 | Foster et al. | |
| 6,901,647 | B2 | 6/2005 | Foster et al. | |
| 6,948,234 | B1 | 9/2005 | Steiner | |
| 7,028,393 | B2 * | 4/2006 | Wei | 29/761 |
| 7,096,573 | B2 | 8/2006 | Holliday | |
| 7,120,997 | B2 * | 10/2006 | Islam et al. | 29/751 |
| 7,210,327 | B1 | 5/2007 | Tarpill et al. | |
| 7,299,542 | B2 | 11/2007 | Montena | |
| 7,299,543 | B2 | 11/2007 | Montena | |
| 7,346,980 | B2 * | 3/2008 | Liao | 29/758 |
| 7,383,714 | B2 | 6/2008 | DiMilia et al. | |
| 7,562,442 | B2 * | 7/2009 | Montena | 29/751 |
| 7,607,218 | B2 * | 10/2009 | Montena et al. | 29/759 |
| 7,685,702 | B2 * | 3/2010 | Sutter et al. | 29/749 |
| 7,703,196 | B2 * | 4/2010 | Chawgo | 29/751 |
| 7,761,979 | B2 * | 7/2010 | Wang | 29/758 |
| 2004/0110416 | A1 * | 6/2004 | Montena et al. | 439/578 |
| 2006/0021216 | A1 | 2/2006 | Islam et al. | |
| 2007/0082546 | A1 * | 4/2007 | Chawgo | 439/585 |
| 2007/0251085 | A1 * | 11/2007 | Holliday et al. | 29/751 |
| 2008/0201941 | A1 * | 8/2008 | Montena | 29/751 |
| 2009/0064490 | A1 * | 3/2009 | Chawgo et al. | 29/753 |

* cited by examiner

COAXIAL CABLE INSTALLATION TOOL

CROSS-REFERENCE TO RELATED APPLICATIONS

This application claims the benefit of U.S. Provisional Application No. 61/143,031, filed on Jan. 7, 2009, the specification of which is incorporated by reference herein in its entirety for all purposes.

BACKGROUND OF THE INVENTION

The present invention relates generally to connecting connectors to coaxial cable. More particularly, the present invention relates to an installation tool for connecting a coaxial cable to a connector.

It has long been known to use connectors to terminate coaxial cable so as to connect a cable to various electronic devices such as televisions, radios and the like. Prior art coaxial connectors generally include a connector body having an annular collar for accommodating a coaxial cable, an annular nut rotatably coupled to the collar for providing mechanical attachment of the connector to an external device and an annular post interposed between the collar and the nut. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator.

Upon attachment with a connector, a coaxial cable is inserted into the cable receiving end of the connector body, wherein the annular post is forced between the foil covered insulator and the conductive shield of the cable. In this regard, the post is typically provided with a radially enlarged barb to facilitate expansion of the cable jacket. The locking sleeve is then moved axially into the connector body to clamp the cable jacket against the post barb providing both cable retention and a water-tight seal around the cable jacket. The connector can then be attached to an external device by tightening the internally threaded nut to an externally threaded terminal or port of the external device.

Various installation tools to facilitate the assembly of a coaxial cable to a connector are known in the art. Commonly used prior art installation tools are typically hand-held devices resembling pliers that provide the necessary force for driving the locking sleeve in order to lock the cable to the connector. When the handles of such tools are squeezed together, a jaw mechanism of the tool typically pushes or inserts the locking sleeve of the connector into the connector body to secure the cable in the connector. However, this requires prior manual insertion of a prepared end of the cable into engagement with the tubular post contained within the connector body. Since the post expands the coaxial cable braid, some level of force is required on the part of the installer in order to fully insert the cable to its proper position within the connector body for proper connector compression/installation. Also, ensuring that the cable is inserted the precise required distance into the connector is further problematic with such manual assembly.

Accordingly, it is desirable to provide an installation tool that simplifies the coaxial cable to connector assembly process. It is further desirable to provide a cable installation tool that exerts the necessary forces to both install the cable an exact distance into the connector and also to compress the locking sleeve in one application.

OBJECTS AND SUMMARY OF THE INVENTION

It is an object of the present invention to provide a tool for assembling a coaxial cable to a connector.

It is a further object of the present invention to provide a coaxial cable installation tool having structure to exert the necessary forces to both install the cable an exact distance into the connector and also to compress the locking sleeve of the connector in one application.

In the efficient attainment of these and other objects, the present invention provides a coaxial cable installation tool. The installation tool of the present invention generally includes a front jaw assembly adapted to retain a cable connector and a back jaw assembly movably coupled to the front jaw assembly. The cable connector includes a connector body and a compression sleeve and the back jaw assembly is adapted to insert an end of the cable into the cable connector upon movement of the back jaw assembly toward the front jaw assembly and subsequently press the compression sleeve into the connector body upon further movement of the back jaw assembly toward the front jaw assembly.

In a preferred embodiment, the front jaw assembly of the cable installation tool includes an actuator shaft extending in a rearward direction toward the back jaw assembly, wherein the back jaw assembly is traversable along the actuator shaft. The actuator shaft preferably includes a shaft body and a radially enlarged cam portion, wherein the cam portion causes the back jaw assembly to grip the cable as the back jaw assembly traverses over the cam portion, and wherein the back jaw assembly releases the cable as the back jaw assembly traverses over the shaft body toward the front jaw assembly.

The actuator shaft further preferably includes a ramped surface between the shaft body and the cam portion for facilitating smooth engagement of the cam portion with the back jaw assembly as the back jaw assembly traverses over the cam portion. Also, the shaft body and the enlarged cam portion are preferably circular in cross-section.

The front jaw assembly further preferably includes a U-shaped pocket for receiving the connector body and a flange extending into the pocket for engaging the connector body to prevent axial movement of the connector body in the tool.

The back jaw assembly preferably includes a gripper mechanism movably engaged with the actuator shaft. The gripper mechanism closes to grip the cable when the gripper mechanism is engaged with the cam portion of the actuator shaft, and opens to release the cable when the gripper mechanism is not engaged with the cam portion of said actuator shaft.

The gripper mechanism preferably includes a pair of gripper arms pivotably connected to the back jaw assembly. The gripper arms form a closable cable gripping mouth at one end thereof for gripping the cable and a closable actuator shaft opening at an opposite end thereof for engagement with the cam portion of the actuator shaft. The gripper arms are preferably spring-biased and the actuator shaft opening is preferably at least partially surrounded by a chamfered surface for facilitating smooth engagement with the cam portion of the actuator shaft. The closable actuator shaft opening of the gripper arms has an axial depth, which, together with the axial length of the radially enlarged cam portion of the actuator shaft, matches the desired depth of cable insertion into the connector.

The back jaw assembly further preferably includes a cable receiving pocket for receiving the cable and an actuator shaft aperture for receiving the actuator shaft. In addition, the back jaw assembly further preferably includes a forward face facing the front jaw assembly for pressing the compression sleeve into the connector body.

The cable installation tool of the present invention further preferably includes a pair of pivotably connected handles connected to the front jaw assembly and the back jaw assembly for moving the front jaw assembly and the back jaw assembly together and apart.

The present invention further involves a method for installing an end of a cable into a connector. The method generally includes the steps of retaining a cable connector in a front jaw assembly of a cable installation tool, inserting the end of the cable into the connector body, gripping the cable with a back jaw assembly of the cable installation tool upon initial movement of the back jaw assembly toward the front jaw assembly, further inserting the cable into the connector body upon further movement of the back jaw assembly toward the front jaw assembly, releasing the cable from the back jaw assembly upon further movement of the back jaw assembly toward the front jaw assembly and pressing the compression sleeve into the connector body with the back jaw assembly by further moving the back jaw assembly toward the front jaw assembly thereby securing the cable in the connector.

A preferred form of the coaxial cable installation tool, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
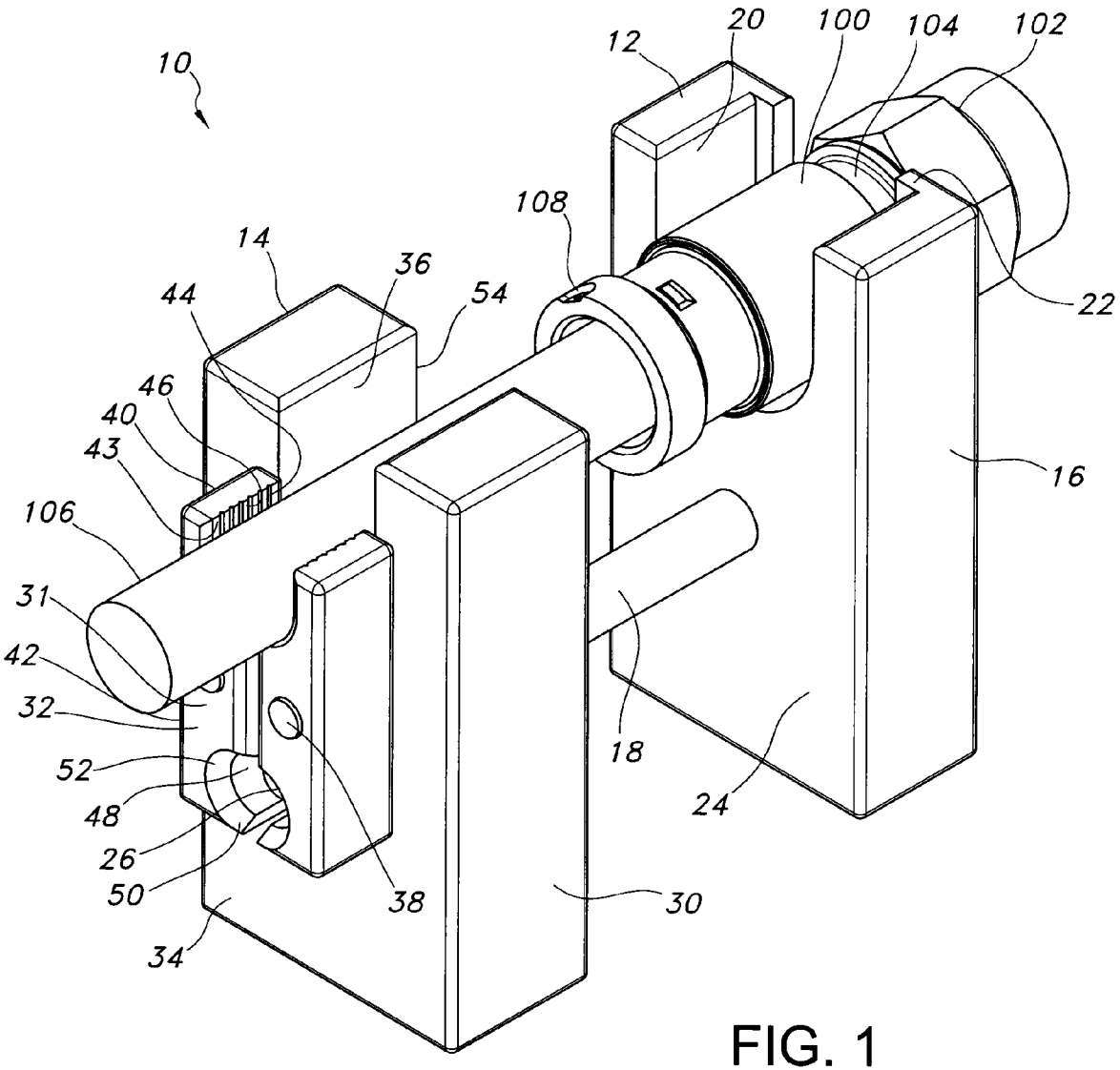
FIG. 1 is a top front perspective view of a preferred embodiment of the coaxial cable installation tool formed in accordance with the present invention.
Figure 1B:
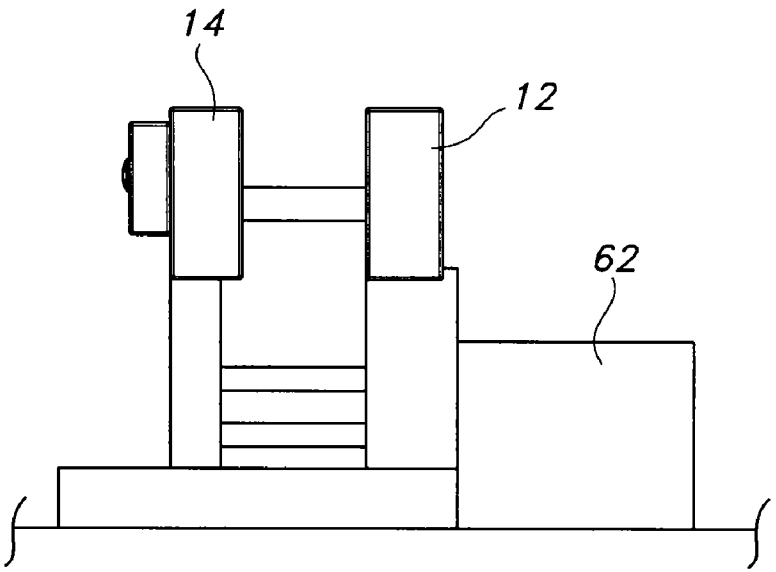
FIG. 1*b* is a side view of the coaxial cable installation tool shown in FIG. 1 in a bench-top tool configuration.
Figure 1A:
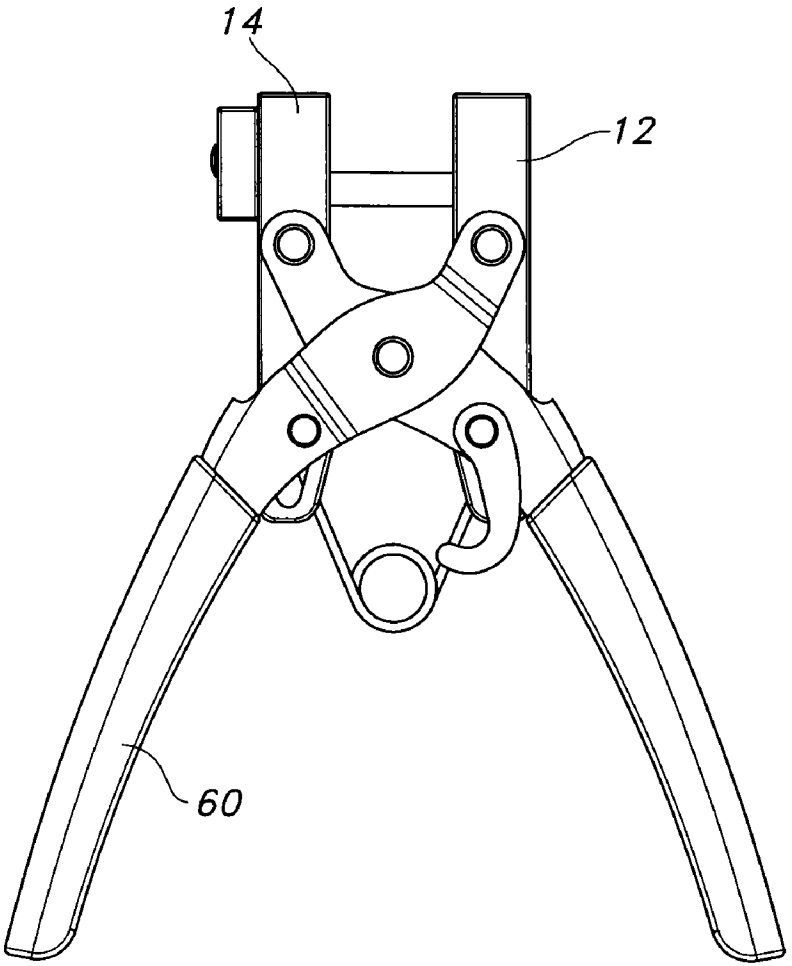
FIG. 1*a* is a side view of the coaxial cable installation tool shown in FIG. 1 in a hand-tool configuration.

Referring to the drawings, a preferred embodiment of the coaxial cable installation tool 10 of the present invention is shown. The tool 10 generally includes a front jaw assembly 12 movably coupled to a back jaw assembly 14. It is to be noted that the drawings show only the front jaw assembly 12 and the back jaw assembly 14 of the tool 10. The actuating mechanism for driving the jaw assemblies 12 and 14 together and apart is not shown in the detailed drawings of FIGS. 1-9. Such actuating mechanism can include conventional handles 60 for a hand-tool configuration, as shown in FIG. 1*a*, or a lever or a powered source 62, (such as a hydraulic cylinder or an electromechanical drive), for a bench-top tool configuration, as shown in FIG. 1*b*.

The front jaw assembly 12 includes a front jaw member 16 and an actuator shaft 18 fixed to the front jaw member. The front jaw member 16 is formed with a U-shaped pocket or receptacle 20 sized to receive the connector body 100 of a coaxial cable connector 102. The front jaw member 16 is further formed with an inwardly directed flange 22 surrounding the forward periphery of the connector pocket 20. The inwardly directed flange 22 is received within a groove 104 formed in the connector body 100 during use. Specifically, when the connector 102 is placed in the connector pocket 20 of the front jaw member 16, the flange 22 engages the groove 104 to prevent any axial movement of the connector body 100 with respect to the front jaw assembly 12.

The actuator shaft 18 extends from a rear face 24 of the front jaw member 16 and is received in an actuator shaft aperture 26 formed in the back jaw assembly 14. The actuator shaft 18 can be an integral part of the front jaw member 16, or it can be a separate part fixed to the front jaw member in a conventional manner. In either case, the actuator shaft 18 remains stationary with respect to the front jaw member 16 during use.

As shown in FIGS. 2-9, the actuator shaft 18 includes a shaft body 27 and a radially enlarged cam portion 28 disposed adjacent the rearward end of the actuator shaft, the function of which will be discussed in further detail below. The radially enlarged cam portion 28 has a diameter or width larger than the shaft body 27 and preferably includes ramped surfaces 29 at its forward and rearward extents. The ramped surfaces 29 provide a smooth transition between the outer surface of the actuator shaft body 27 and the radially enlarged cam portion 28, as will be described in further detail below. The shaft body 27 and the cam portion 28 shown in the drawings have circular cross-sections, but other cross-sectional shapes are conceivable.

The back jaw assembly 14 includes a back jaw member 30 and a gripper mechanism 31 attached thereto for alternately gripping and releasing a cable 106 during installation in a connector 100. The gripper mechanism 31 can take various forms, but preferably includes a pair of opposing gripper arms 32 pivotably attached to a rear face 34 of the back jaw member. The back jaw member 30 is formed with a U-shaped cable receiving pocket 36, as well as the actuator shaft aperture 26 mentioned above. The cable receiving pocket 36 is sized to receive a coaxial cable 106 and the actuator shaft aperture 26 is positioned below the cable receiving pocket and is sized to receive the cam portion 28 of the actuator shaft 18. Sufficient clearance is provided between the cable receiving pocket 36 and the cable 106 and between the actuator shaft aperture 26 and the cam portion 28 of the actuator shaft 18 to permit the back jaw assembly 14 to translate forward along the cable and the actuator shaft toward the front jaw assembly 12 during use, as will be described in further detail below.

The gripper arms 32 may be pivotably attached to the rear face 34 of the back jaw member 30 via pins 38 fixed in the back jaw member. Each gripper arm 32 includes a cable engagement end 40 and an opposite cam engagement end 42 with a pin 38 disposed therebetween. As a result, when the gripper arm 32 pivots about the pin 38, the cable engagement end 40 moves in one of an inward or outward direction and the opposite cam engagement end 42 moves in the opposite inward or outward direction.

The inner surface of the cable engagement end 40 of each gripper arm 32 is formed with a notch 43 to grip one side of the cable 106 during use. The notches 43 of each gripper arm 32 are preferably provided with a serrated or other textured surface 44 to enhance gripping of the cable 106. The gripper arms 32 are attached to the back jaw member 30 such that the notches 43 at the cable engagement ends 40 are positioned facing each other on opposite sides of the cable receiving pocket 36 of the back jaw member. In this manner, the notches 43 together form a closable mouth 46 to grip the cable 106.

The gripper arms 32 are further preferably spring-biased about the pivot pins 38 to urge the cable engagement ends 40 apart, whereby the closable mouth 46 is normally maintained in an open position to receive a cable 106 during use. Such biasing force can be provided, for example, by a tension spring 64 connected between the gripper arms 32, as shown in FIG. 2.

The inner face of the opposite cam engagement end 42 of each gripper arm 32 is formed with a semi-circular recess 48 that engages the actuator shaft 18. The recesses 48 of the gripper arms 32 face each other to form a circular opening 50 through which the actuator shaft traverses during use. The recesses 48 are preferably surrounded by chamfered surfaces 52 formed in the forward and rearward faces of the gripper arms 32, which, together with the ramped surfaces 29 of the actuator shaft cam portion 28, facilitate smooth transition between the cam portion and the shaft body 27 as the actuator shaft 18 traverses through the circular opening 50 during use, as will be discussed in further detail below.

Figure 3:
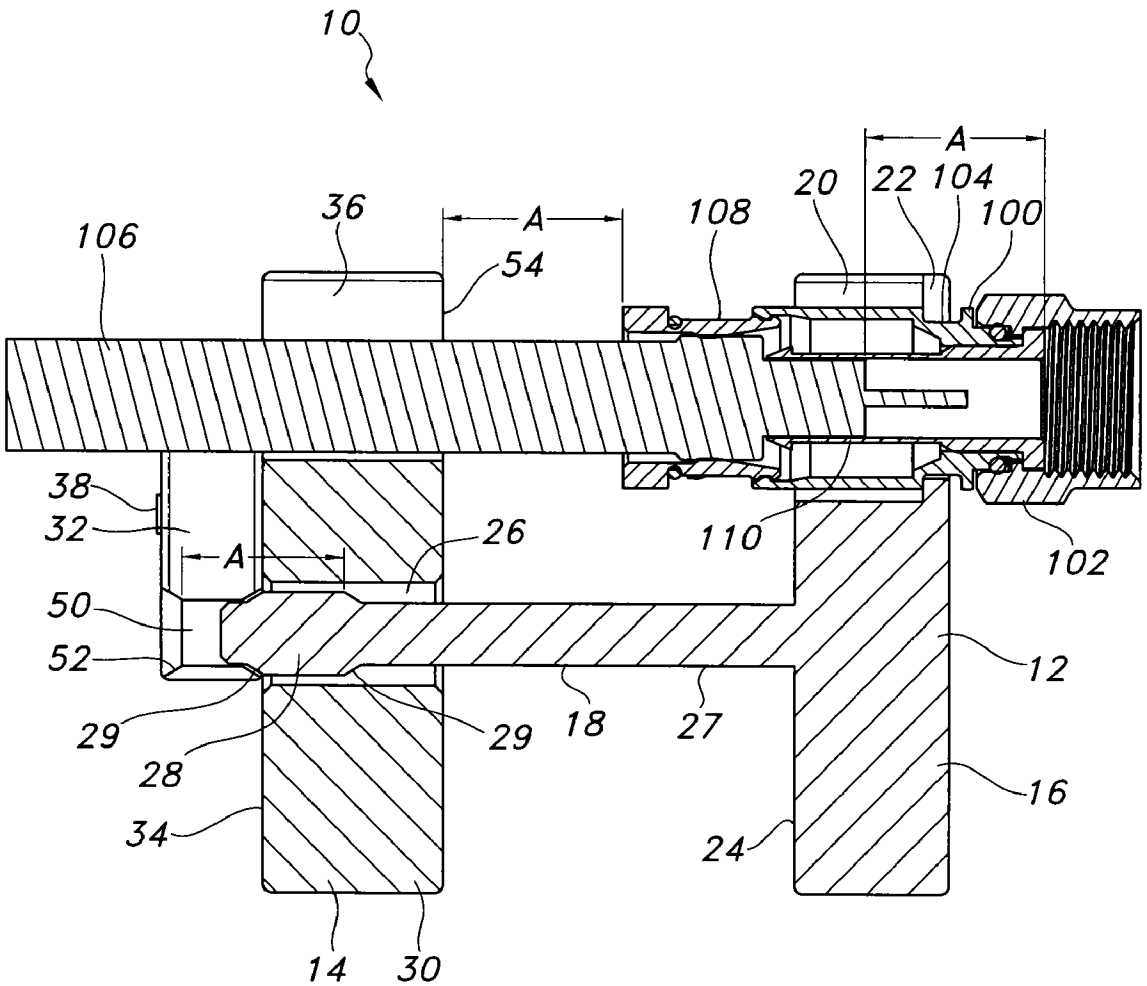
FIG. 3 is a cross-sectional view of the tool shown in FIG. 2.

Having thus far described the structural components of the tool 10, use of the tool will now be sequentially described with reference to FIGS. 2-9. First, the end of a coaxial cable 106 is prepared in a conventional manner by stripping the cable jacket and folding back the braid. Next, with the tool 10 in the open position, whereby the front and back jaw assemblies 12 and 14 are separated to their fullest extent, as shown in FIGS. 2 and 3, a coaxial cable connector 102 is placed in the connector pocket 20 of the front jaw assembly 12 and a cable 106 is loosely placed in the cable receiving pocket 36 of the back jaw assembly 14. At this point, the prepared end of the cable 106 can be manually inserted through the locking sleeve 108 of the connector 102 until it engages with the annular post 110 of the connector. This initial insertion requires only minimal force by the installer.

Figure 2:
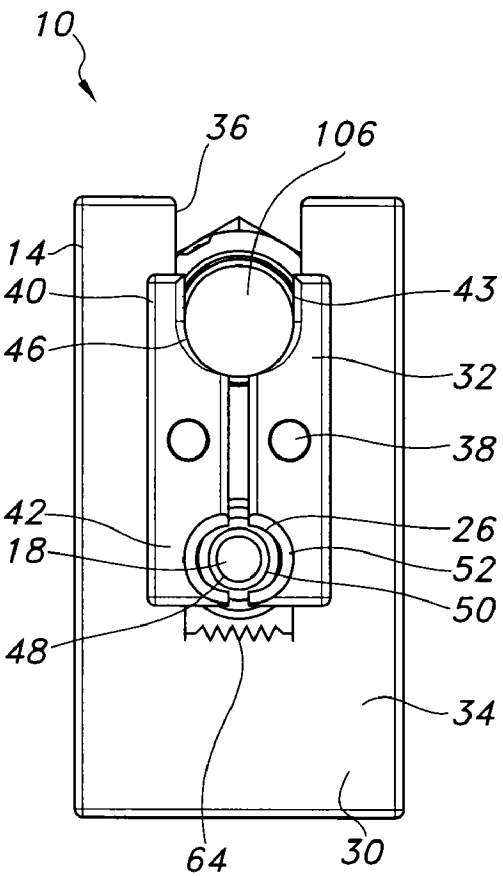
FIG. 2 is a front plan view of the tool shown in FIG. 1 with the cable and connector ready for installation.

With the tool 10 in the open position, as shown in FIGS. 2 and 3, only the rearward-most end of the shaft body 27 is received in the actuator shaft opening 50 of the gripper arms 32. The reduced diameter of the rearward end of the shaft body 27 keeps the cam engagement ends 42 of the gripper arms 32 close together, whereby the opposite cable engagement ends 40 are separated.

Figure 5:
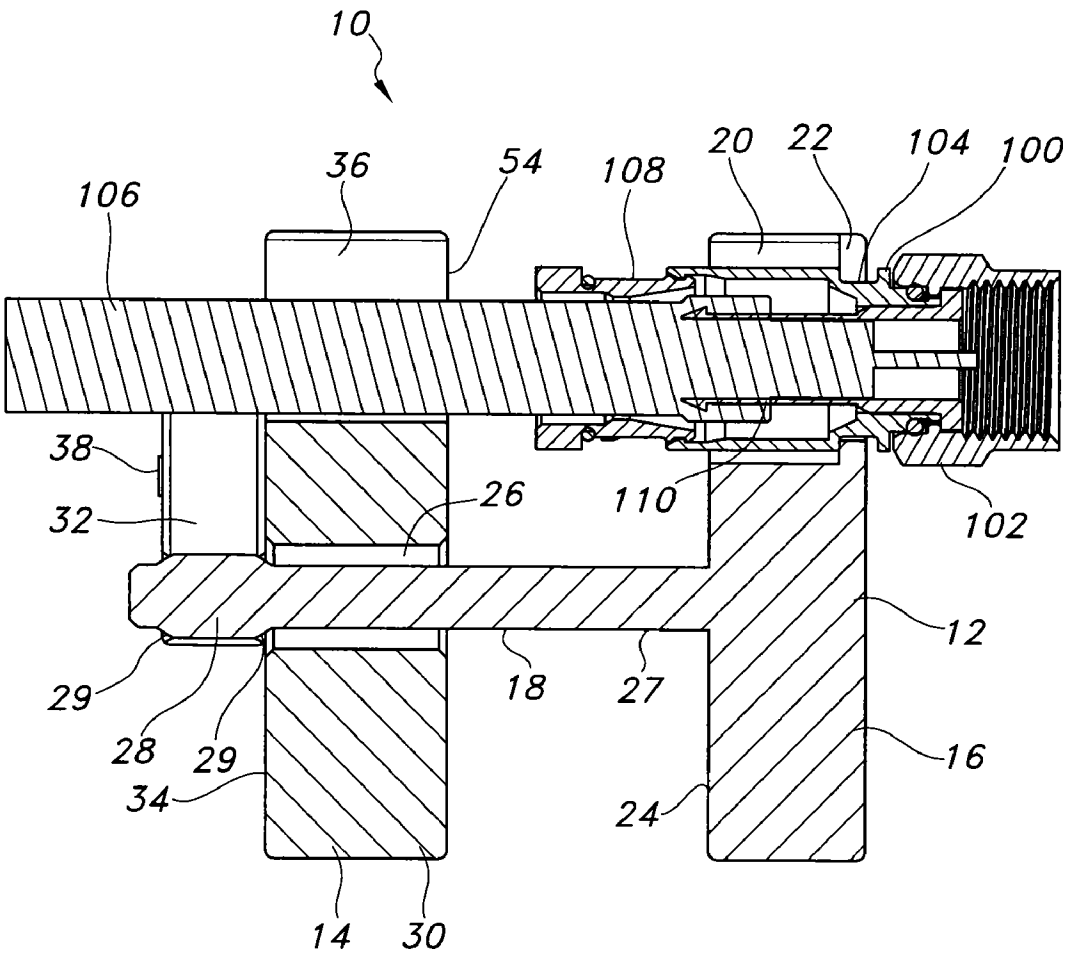
FIG. 5 is a cross-sectional view of the tool shown in FIG. 4.
Figure 4:
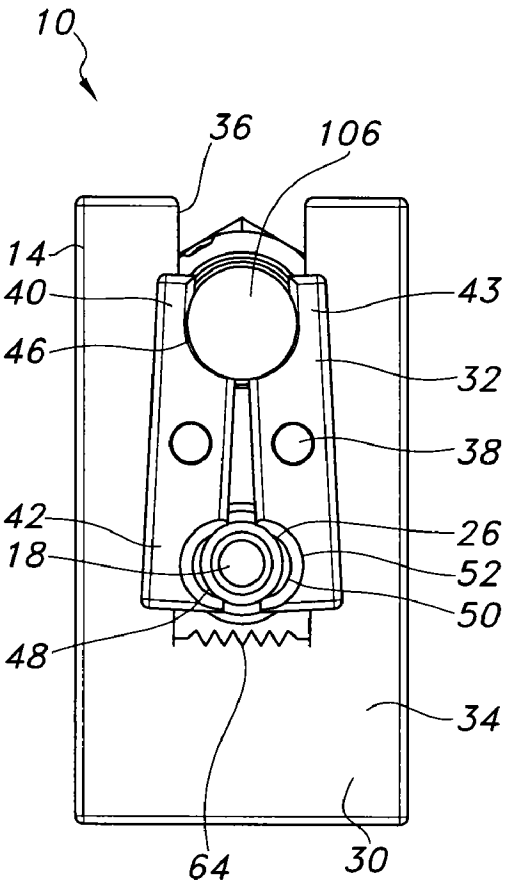
FIG. 4 is a front plan view of the tool shown in FIG. 1 with the cable inserted half way into the connector.

As the front jaw assembly 12 and the back jaw assembly 14 begin to move together as shown in FIGS. 4 and 5, the cam portion 28 of the actuator shaft 18 engages the circular opening 50 of the gripper arms 32 causing the cam engagement ends 42 of the gripper arms to move apart. Separation of the cam engagements ends 42 of the gripper arms 32 causes the cable engagement ends 40 to move closer together to grip the cable 106. With the cable 106 thus gripped, further forward movement of the back jaw assembly 14 forces the cable further into the connector 102 to secure the cable to the post of the connector.

As the back jaw assembly 14 moves further forward toward the front jaw assembly 12, the cam portion 28 of the actuator shaft 18 slides through the circular opening 50 of the gripper arms 32 and eventually moves out of engagement with the circular opening 50 of the gripper arms 32. As the cam portion 28 of the actuator shaft 18 exits the actuator shaft opening 50, the reduced diameter of the shaft body portion 27 allows the spring force applied to the gripper arms 32 to cause the cam engagement ends 42 to return together. The resultant pivoting of the gripper arms 32 separates the opposite cable engagement ends 40 of the gripper arms, thereby releasing the cable 106.

Figure 7:
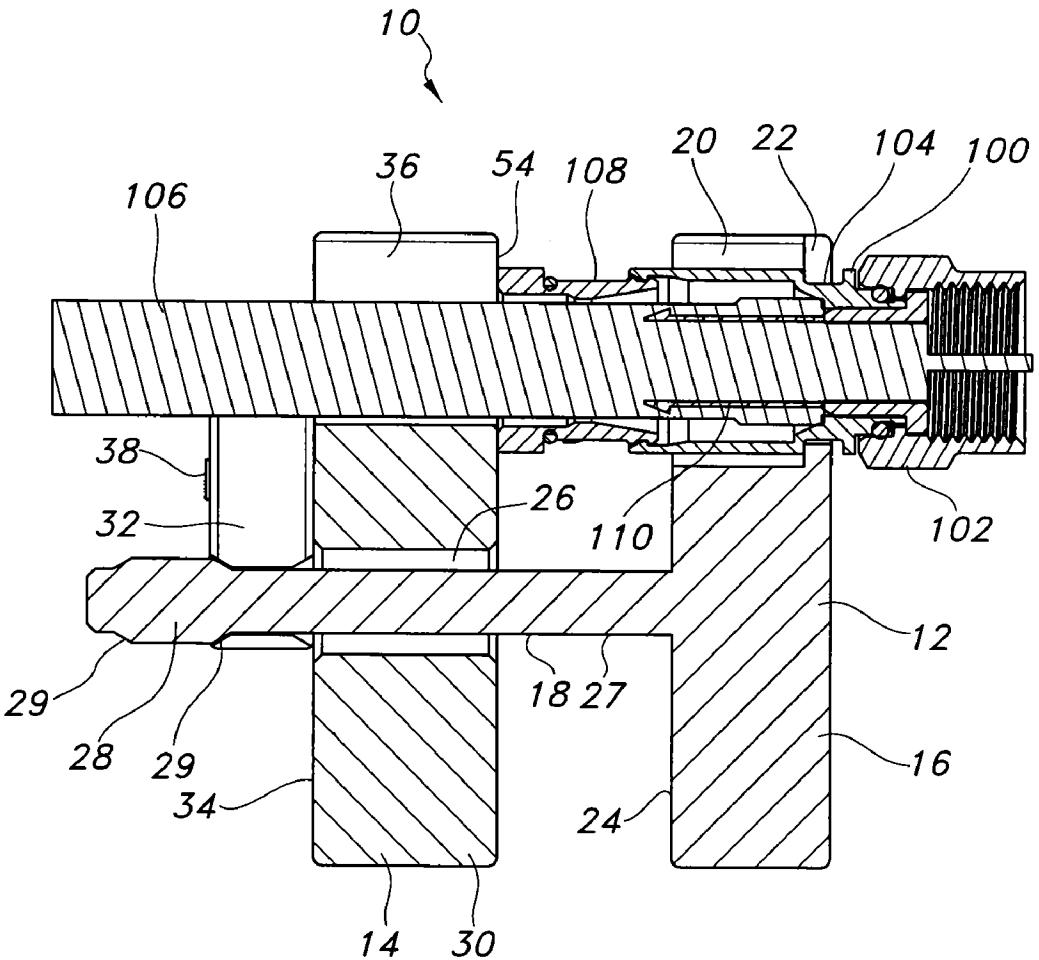
FIG. 7 is a cross-sectional view of the tool shown in FIG. 6.
Figure 6:
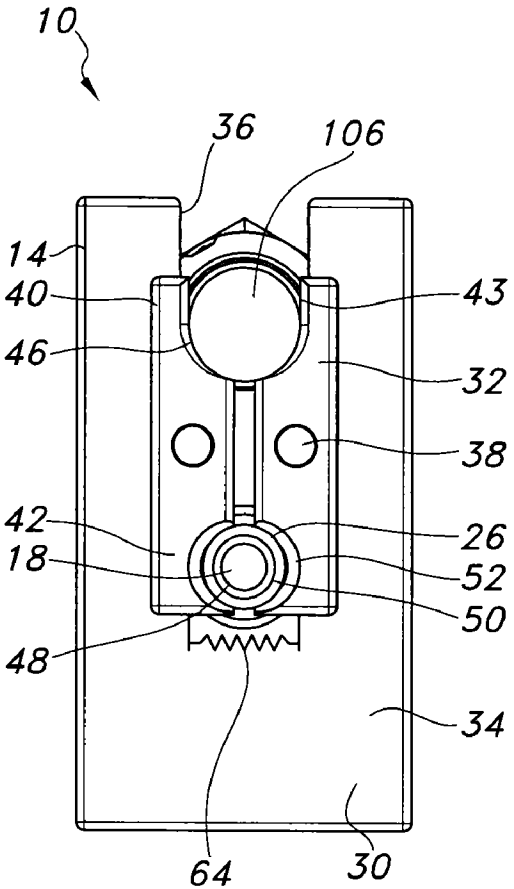
FIG. 6 is a front plan view of the tool shown in FIG. 1 with the cable fully inserted into the connector.
Figure 9:
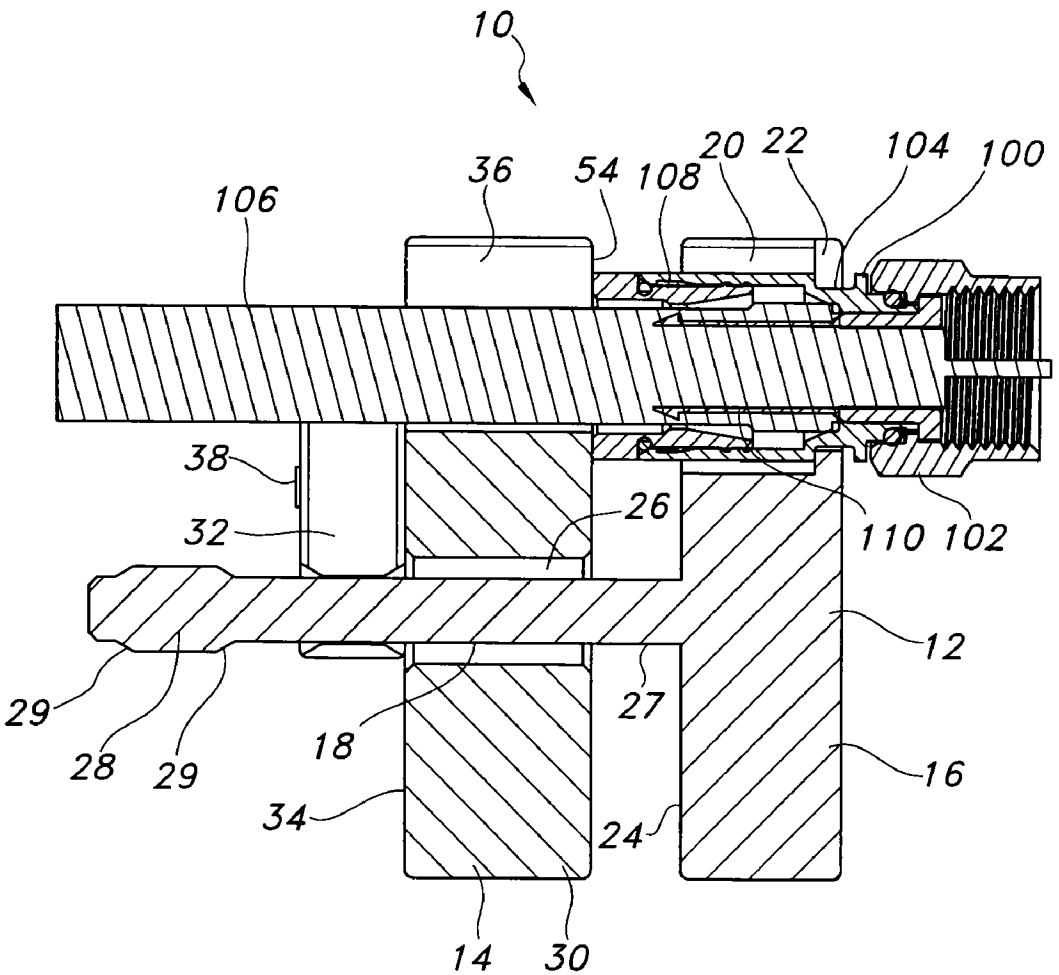
FIG. 9 is a cross-sectional view of the tool shown in FIG. 8.
Figure 8:
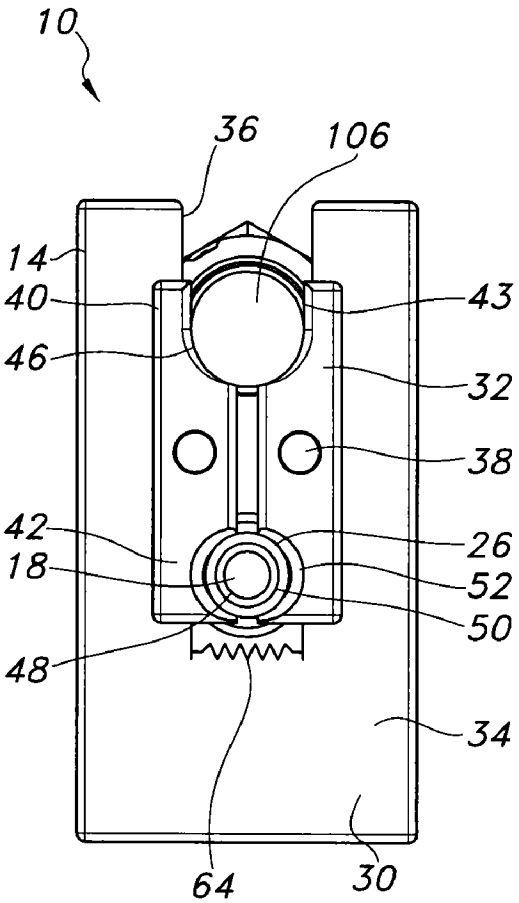
FIG. 8 is a front plan view of the tool shown in FIG. 1 with the connector sleeve compressed and the connector installation complete.

Further forward movement of the back jaw assembly 14 toward the front jaw assembly 12 causes a forward face 54 of the back jaw member 30 to come into contact with a rearward face of the compression sleeve 108 of the connector 102, as shown in FIGS. 6 and 7. The back jaw assembly 14 is then driven still further to press the compression sleeve 108 into the connector body 100 as shown in FIGS. 8 and 9. Once the cable is fully inserted as shown in FIGS. 8 and 9, the installed connector and cable can be removed from the tool 10 by slightly releasing the front and back jaw assemblies 12 and 14.

In this regard, the axial length of the cam portion 28 of the actuator shaft 18 together with the axial depth of the closable actuator shaft opening 50 of the gripper arms 32 preferably has a length A that matches the desired depth A of cable insertion into the connector, as shown in FIG. 3. In most coaxial cable installation applications, the dimension A is between about 0.375 and 0.625 inches, and is preferably about 0.430 inches.

It is also desirable to ensure that the body portion 27 of the actuator shaft 18 has a length sufficient to enable the back jaw assembly 14 to traverse the actuator shaft a distance at least as much as the dimension A before engaging the locking sleeve 108 of the connector. In other words, the body portion 27 of the actuator shaft 18 preferably has a length that will ensure that the front face 54 of the back jaw member 30 does not make contact with the locking sleeve 108 until the cable 106 has been inserted the desired depth A. In a preferred embodiment, the front face 54 of the back jaw member 30 makes contact with the locking sleeve 108 at the moment that the cable 106 has been inserted the desired depth A. To accomplish this, the length of the body portion 27 of the actuator shaft 18 is chosen taking into account the dimension A, the depth of the back jaw member 30, the depth of the connector receiving pocket 20 and the axial dimensions of the connector components. As can be appreciated, the length of the body portion 27 of the actuator shaft 18 will vary depending on all of these factors.

The diameter or width of the cam portion 28 is also chosen to provide the desired gripping force on the cable 106 by the gripping arms 32 without damaging the cable. The gripping force of the gripping arms 32 is also determined by the depth of the notches 42 and the recesses 48 of the gripping arms, as well as the length of the gripper arms and the spacing of the gripper arm pivot pins 38.

As a result of the present invention, an installation tool is provided that performs both the cable insertion operation, in addition to the subsequent step of connector compression. The benefit of the present invention is an installation process that is faster and easier.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A cable installation tool comprising:

a front jaw assembly adapted to retain a cable connector, the cable connector including a connector body and a compression sleeve; and a back jaw assembly movably coupled to said front jaw assembly, said back jaw assembly being adapted to insert an end of the cable into the cable connector upon movement of said back jaw assembly toward said front jaw assembly and subsequently press the compression sleeve into the connector body upon further movement of said back jaw assembly toward said front jaw assembly.

2. A cable installation tool as defined in claim 1, wherein said front jaw assembly comprises an actuator shaft extending in a rearward direction toward said back jaw assembly, said back jaw assembly being traversable along said actuator shaft.

3. A cable installation tool as defined in claim 2, wherein said actuator shaft comprises a shaft body and a radially enlarged cam portion, said cam portion causing said back jaw assembly to grip the cable as said back jaw assembly traverses over said cam portion, and wherein said back jaw assembly releases the cable as said back jaw assembly traverses over said shaft body toward said front jaw assembly.

4. A cable installation tool as defined in claim 3, wherein said actuator shaft further comprises a ramped surface between said shaft body and said cam portion for facilitating smooth engagement of said cam portion with said back jaw assembly as said back jaw assembly traverses over said cam portion.

5. A cable installation tool as defined in claim 3, wherein said shaft body and said enlarged cam portion are circular in cross-section.

6. A cable installation tool as defined in claim 3, wherein said back jaw assembly comprises a gripper mechanism movably engaged with said actuator shaft, said gripper mechanism closing to grip the cable when said gripper mechanism is engaged with said cam portion of said actuator shaft, and said gripper mechanism opening to release the cable when said gripper mechanism is not engaged with said cam portion of said actuator shaft.

7. A cable installation tool as defined in claim 6, wherein said gripper mechanism comprises a pair of gripper arms pivotably connected to said back jaw assembly, said pair of gripper arms forming a closable cable gripping mouth at one end thereof for gripping the cable and a closable actuator shaft opening at an opposite end thereof for engagement with said cam portion of said actuator shaft.

8. A cable installation tool as defined in claim 7, wherein said cam portion of said actuator shaft has an axial length and said closable actuator shaft opening of said pair of gripper arms has an axial depth, the axial length of said cam portion of said actuator shaft together with said axial depth of said closable actuator shaft opening of said pair of gripper arms matching a desired insertion depth of the cable into the connector.

9. A cable installation tool as defined in claim 7, wherein said gripper arms are spring-biased.

10. A cable installation tool as defined in claim 7, wherein said actuator shaft opening is at least partially surrounded by a chamfered surface for facilitating smooth engagement with said cam portion of said actuator shaft.

11. A cable installation tool as defined in claim 1, further comprising a pair of pivotably connected handles connected to said front jaw assembly and said back jaw assembly for moving said front jaw assembly and said back jaw assembly together and apart.

12. A cable installation tool as defined in claim 1, wherein said front jaw assembly includes a U-shaped pocket for receiving the connector body and a flange extending into said pocket for engaging the connector body to prevent axial movement of the connector body.

13. A cable installation tool as defined in claim 2, wherein said back jaw assembly comprises a cable receiving pocket for receiving the cable and an actuator shaft aperture for receiving said actuator shaft.

14. A cable installation tool as defined in claim 1, wherein said back jaw assembly comprises a forward face facing said front jaw assembly for pressing the compression sleeve into the connector body.

15. A method for installing an end of a cable into a connector comprising the steps of:

retaining a cable connector in a front jaw assembly of a cable installation tool, the connector including a connector body and a compression sleeve;

inserting the end of the cable into the connector body;

gripping the cable with a back jaw assembly of the cable installation tool upon initial movement of the back jaw assembly toward the front jaw assembly;

further inserting the cable into the connector body with the back jaw assembly upon further movement of the back jaw assembly toward the front jaw assembly;

releasing the cable from the back jaw assembly upon further movement of the back jaw assembly toward the front jaw assembly; and pressing the compression sleeve into the connector body with the back jaw assembly by further moving the back jaw assembly toward the front jaw assembly thereby securing the cable in the connector.

16. A method as defined in claim 15, wherein the front jaw assembly comprises an actuator shaft extending in a rearward direction toward the back jaw assembly, the actuator shaft causing the back jaw assembly to alternately grip and release the cable as the back jaw assembly traverses along the actuator shaft.

17. A method as defined in claim 16, wherein the actuator shaft comprises a shaft body and a radially enlarged cam portion, the cam portion causing the back jaw assembly to grip the cable as the back jaw assembly traverses over the cam portion, and wherein the back jaw assembly releases the cable as the back jaw assembly traverses over the shaft body toward the front jaw assembly.

18. A method as defined in claim 17, wherein the back jaw assembly comprises a gripper mechanism movably engaged with the actuator shaft, the gripper mechanism closing to grip the cable when the gripper mechanism is engaged with the cam portion of the actuator shaft, and the gripper mechanism opening to release the cable when the gripper mechanism is not engaged with the cam portion of the actuator shaft.

19. A method as defined in claim 18, wherein the gripper mechanism comprises a pair of gripper arms pivotably connected to the back jaw assembly, the pair of gripper arms forming a closable cable gripping mouth at one end thereof for gripping the cable and a closable actuator shaft opening at an opposite end thereof for engagement with the cam portion of the actuator shaft.

20. A method as defined in claim 19, wherein said cam portion of said actuator shaft has an axial length and said closable actuator shaft opening of said pair of gripper arms has an axial depth, the axial length of said cam portion of said actuator shaft together with said axial depth of said closable actuator shaft opening of said pair of gripper arms matching a desired insertion depth of the cable into the connector.

* * * * *